US008102232B2

(12) United States Patent
Yan et al.

(10) Patent No.: US 8,102,232 B2
(45) Date of Patent: Jan. 24, 2012

(54) VARIABLE INDUCTOR

(76) Inventors: Yuejun Yan, Shenzhen (CN); Yuepeng Yan, Shenzhen (CN)

( * ) Notice: Subject to any disclaimer, the term of this patent is extended or adjusted under 35 U.S.C. 154(b) by 0 days.

(21) Appl. No.: 11/838,444

(22) Filed: Aug. 14, 2007

(65) Prior Publication Data

US 2008/0122568 A1 May 29, 2008

(30) Foreign Application Priority Data

Nov. 24, 2006 (CN) ..... 2006 1 0157086
Dec. 12, 2006 (CN) ..... 2006 1 0156510

(51) Int. Cl.
*H01F 5/00* (2006.01)
*H01F 21/02* (2006.01)

(52) U.S. Cl. ..... 336/200; 336/223; 336/232; 336/146; 336/149

(58) Field of Classification Search ..... 336/200, 336/223, 232, 121, 122, 129, 222, 141, 146, 336/147
See application file for complete search history.

(56) References Cited

U.S. PATENT DOCUMENTS 2,682,643 A * 6/1954 Thias ..... 336/79
5,239,289 A * 8/1993 Ferraiolo et al. ..... 336/180
5,574,410 A * 11/1996 Collins et al. ..... 333/17.3
5,629,553 A * 5/1997 Ikeda et al. ..... 257/531
5,793,096 A * 8/1998 Yu et al. ..... 257/531
6,556,416 B2 * 4/2003 Kunihiro ..... 361/277
6,556,849 B2 * 4/2003 Zhou et al. ..... 505/210
6,746,891 B2 * 6/2004 Cunningham et al. ..... 438/52
6,856,499 B2 * 2/2005 Stokes ..... 361/277
6,992,366 B2 * 1/2006 Kim et al. ..... 257/531
7,071,806 B2 * 7/2006 Masu et al. ..... 336/200
7,202,768 B1 * 4/2007 Harvey et al. ..... 336/232
7,372,352 B2 * 5/2008 Lee et al. ..... 336/200
7,432,794 B2 * 10/2008 Mattsson ..... 336/225
7,460,001 B2 * 12/2008 Jessie ..... 336/200
7,598,838 B2 * 10/2009 Hargrove et al. ..... 336/200
7,733,206 B2 * 6/2010 Park ..... 336/200
2005/0068146 A1 * 3/2005 Jessie ..... 336/200
2006/0220775 A1 * 10/2006 Ishikawa ..... 336/200
2007/0182520 A1 * 8/2007 Kawakubo et al. ..... 336/200
2008/0129434 A1 * 6/2008 Khajehpour ..... 336/139

* cited by examiner

*Primary Examiner* — Anh Mai
*Assistant Examiner* — Joselito Baisa
(74) *Attorney, Agent, or Firm* — Matthias Scholl P.C.; Matthias Scholl

(57) ABSTRACT

Provided herein is a variable inductor, comprising a substrate having a surface layer and an inner layer, a plurality of fixed inductors disposed on the substrate, a signal microstrip line serially connecting the fixed inductors to form a serial fixed inductor, a conductive sheet, a signal input terminal, and a signal output terminal, wherein one end of the serial fixed inductor is connected to the signal input terminal, the other end of the serial fixed inductor is connected to the signal output terminal, and the conductive sheet is for controlling the fixed inductors. The variable inductor of this invention is useful in applications where a given number of inductance values are required, so as to efficiently adjust and obtain the required inductance values.

19 Claims, 15 Drawing Sheets

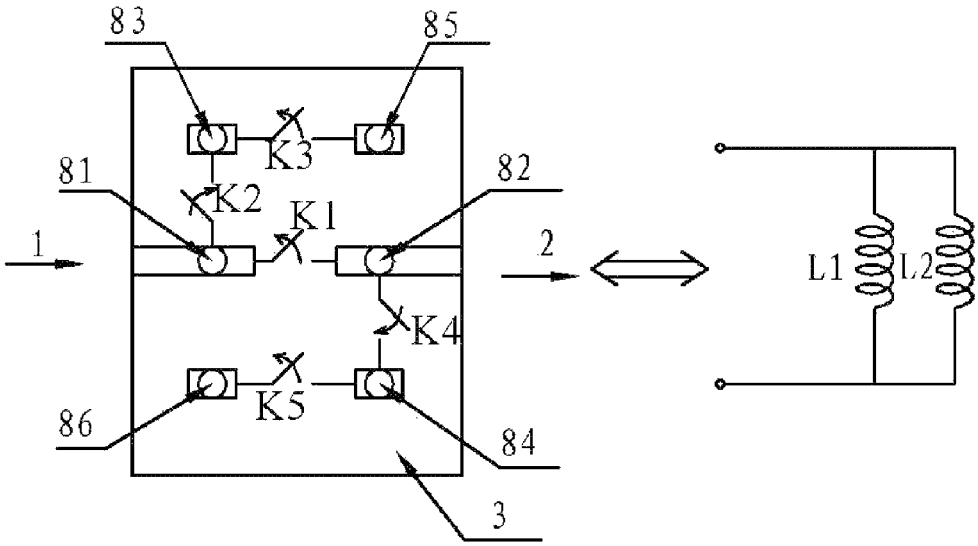
Fig. 12C
Fig. 12c
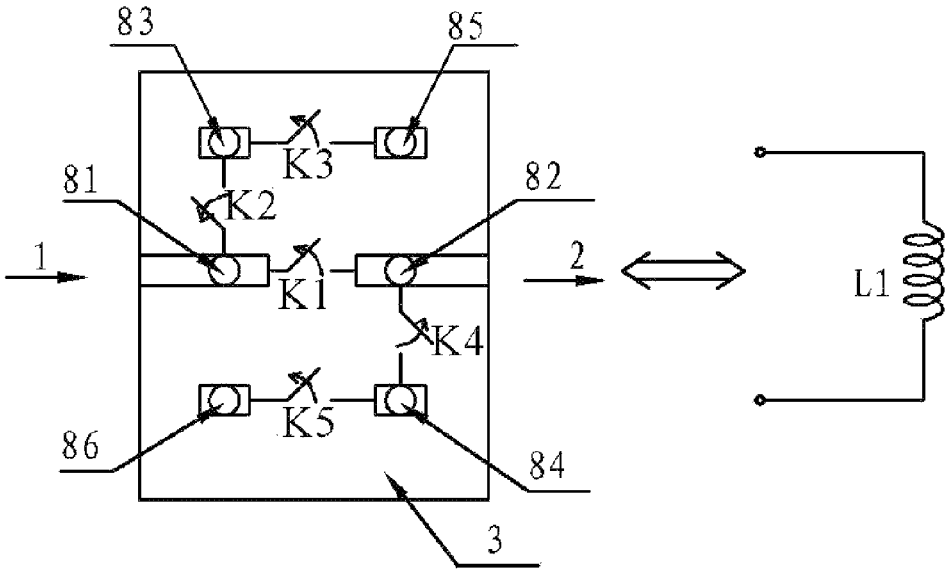
Fig. 12D
Fig. 12d

VARIABLE INDUCTOR

CROSS-REFERENCE TO RELATED APPLICATIONS

This application claims priority to Chinese Patent Application No. 2006101565103 filed on Dec. 12, 2006 and Chinese Patent Application Number 2006101570864 filed on Nov. 24, 2006, the contents of which are incorporated herein by reference.

BACKGROUND OF THE INVENTION

1. Field of the Invention

The invention relates to a variable inductor, and particularly to a variable inductor suitable for use with various high-frequency or microwave circuits.

2. Description of the Related Art

In the family of electronic devices, the existence of variable inductors makes the fabrication of electronic circuits more flexible and convenient. Variable inductors have been widely used in electronic circuits having operating frequencies below hundreds of megahertz (MHz), such as the matching circuit, the tuning circuit, and so on. However, conventional variable inductors are incapable of acting as inductors at high operating frequencies; their frequency characteristics are poor, and the value of the quality factor Q is extremely low. Therefore, conventional variable inductors cannot be used for electronic circuits having high operating frequencies.

Chinese Patent No. 200410027166.9 discloses a variable inductor suitable for high-frequency or microwave circuits, comprising a substrate, a fixed inductor, and signal terminals made of metal microstrip line disposed on the substrate, which also comprises 1) a conductive sheet disposed on the substrate for changing the geometry of the metal microstrip line of the effective inductance portion of the fixed inductor, 2) and an insulator for changing the contact area between the conductive sheet and the metal microstrip line of the fixed inductor, the insulator being adjacent to the conductive sheet.

However, a variable inductor may only operate within a certain range; in case that a number of inductance values are required, it is difficult to efficiently adjust and obtain the required inductance values.

SUMMARY OF THE INVENTION

In view of the above-described problems, it is one objective of the invention to provide a variable inductor suitable for a case where a given number of inductance values are required, so as to efficiently adjust and obtain the required inductance values.

To achieve the above objectives, in accordance with one aspect of the present invention, there is provided a variable inductor, comprising a substrate having a surface layer and an inner layer; a plurality of fixed inductors disposed on the substrate; a signal microstrip line serially connecting the plurality of fixed inductors so as to form a serial fixed inductor; a conductive sheet; a signal input terminal; and a signal output terminal. One end of the serial fixed inductor is connected to the signal input terminal, the other end of the serial fixed inductor is connected to the signal output terminal, and the conductive sheet controls the fixed inductors.

In certain classes of this embodiment, the variable inductor further comprises an insulator for moving the conductive sheet.

In certain classes of this embodiment, one side of the conductive sheet is contacted with one end of the insulator, and the other end of the conductive sheet is connected to the surface layer of the substrate.

In certain classes of this embodiment, the insulator is a printed circuit board for supporting the conductive sheet, and a positioning groove is disposed at an outer edge of the insulator.

In certain classes of this embodiment, the fixed inductor is a microstrip line inductor or a discrete inductor. The fixed inductor is located on the surface layer or the inner layer of the substrate if the fixed inductor is a microstrip line inductor. If the fixed inductor is located on the inner layer of the substrate and the short circuit of the fixed inductor is controlled by the conductive sheet, both ends of the fixed inductor are connected to the surface layer of the substrate. If the fixed inductor is a discrete inductor, the fixed inductor is located on the surface layer of the substrate.

In certain classes of this embodiment, the conductive sheet is replaced by a switch located on the surface layer or the inner layer of the substrate; the fixed inductors are located on the same layer or on a different layer of the substrate from where the switch is located; and if the fixed inductors are located on a different layer of the substrate from where the switch is located, both ends of each of the fixed inductors are connected to the layer on which the switch is located.

In accordance with another aspect of the present invention, there is provided a variable inductor, comprising a substrate having a surface layer and an inner layer; a plurality of fixed inductors disposed on the substrate; at least one conductive sheet is connected in parallel to the fixed inductors to form a parallel fixed inductor; a signal input terminal; and a signal output terminal. One end of the parallel fixed inductor is connected the signal input terminal, the other end of the parallel fixed inductor is connected to the signal output terminal, and the conductive sheet controls the fixed inductors.

In certain classes of this embodiment, the conductive sheet is a switch.

In certain classes of this embodiment, one set of ends of the fixed inductors are joined together (i.e., a first end of a first fixed inductor is connected to a first end of a second fixed inductor and is connected to a first end of a third fixed inductor, and so on), and the other set of ends are joined together via the conductive sheet or the switch.

In certain classes of this embodiment, one set of ends of the fixed inductors are joined together via the conductive sheet or the switch, and similarly the other set of ends are joined together via the conductive sheet or the switch, forming a parallel fixed inductor.

In certain classes of this embodiment, the variable inductor further comprises an insulator for moving the conductive sheet.

In certain classes of this embodiment, one side of the conductive sheet is contacted with one end of the insulator, and the other end of the insulator is connected to the surface layer of the substrate.

In certain classes of this embodiment, the insulator is a printed circuit board for supporting the conductive sheet, and a positioning groove is disposed at an outer edge of the insulator.

In certain classes of this embodiment, the fixed inductor is a microstrip line inductor or a discrete inductor. If the fixed inductor is a microstrip line inductor, the fixed inductor is located on the surface layer or the inner layer of the substrate. If the fixed inductor is located on the inner layer of the substrate and short circuit of the fixed inductor is controlled by the conductive sheet, both ends of each of the fixed inductors are connected to the surface layer of the substrate. If the fixed inductor is a discrete inductor, the fixed inductor is located on the surface layer of the substrate.

In certain classes of this embodiment, the conductive sheet a switch located on the surface layer or the inner layer of the substrate, the fixed inductors are located on the same or on a different layer of the substrate as the switch is located on, and both ends of each of the fixed inductor are connected to the layer on which the switch is located if the fixed inductors are located on a different layer of the substrate from where the switch is located.

In accordance with a further aspect of the present invention, there is provided a variable inductor, comprising a substrate having a surface layer and an inner layer; a fixed inductor disposed on the substrate; and at least one conductive sheet connected in parallel with the fixed inductors to form a parallel fixed inductor; a signal input terminal; and a signal output terminal.

In certain classes of this embodiment, the variable inductor further comprises an insulator for moving the conductive sheet.

In certain classes of this embodiment, the conductive sheet is a switch. One side of the conductive sheet is contacted with one end of the insulator, and the other end of the conductive sheet is connected to the surface layer of the substrate. The fixed inductor is a microstrip line inductor or a discrete inductor. If the fixed inductor is a microstrip line inductor, the fixed inductor is located on the surface layer or the inner layer of the substrate. If the fixed inductor is located on the inner layer of the substrate and short circuit of the fixed inductor is controlled by the conductive sheet, both ends of the fixed inductors are connected to the surface layer of the substrate. If the fixed inductor is a discrete inductor, the fixed inductor is located on the surface layer of the substrate.

In certain classes of this embodiment, the conductive sheet is a switch located on the surface layer or the inner layer of the substrate; the fixed inductors are located on the same layer or on a different layer of the substrate as the switch is located; and if the fixed inductors are located on a different layer of the substrate from where the switch is located, both ends of the fixed inductor are connected to the layer on which the switch is located.

Compared with the prior art, the variable inductor of the present invention provides the following advantages:

a. it can be applied in high frequency or microwave bands to realize accurate adjustment of an inductor;
b. a multi-layered and graded structure greatly decreases the size of the variable inductor;
c. the variable inductor is not limited to a microstrip line inductor, it can also be a discrete inductor;
d. rotatable design makes adjustment simple, and is suitable for mini circuits;
e. its configuration is simple, its fabrication cost is low, and it is easily used by various circuits;
f. it is suitable for various tuning, filtering, matching, adjusting, controlling and stabilizing loops, such as for frequency stabilization, electromagnetic coupling adjustment, and so on;
g. it is suitable for the circuits where a highly precise inductance is required but a big variation of the fixed inductor exists, e.g., where the elements of the loop need to be adjusted to satisfy the characteristics of the entire circuit;
h. it can be used in laboratories as adjusting or testing equipment for research and development; and
i. it may be integrated into a radio frequency integrated circuits (RFIC), hybrid integrated circuits and monolithic microwave integrated circuits (MMIC).

BRIEF DESCRIPTION OF THE DRAWINGS

The invention is described hereinafter with reference to accompanying drawings, in which:

FIGS. 12A-12D and 12*a*-12*d* illustrate a process of adjusting an electric variable inductor;

DETAILED DESCRIPTION OF THE INVENTION

Figure 1:
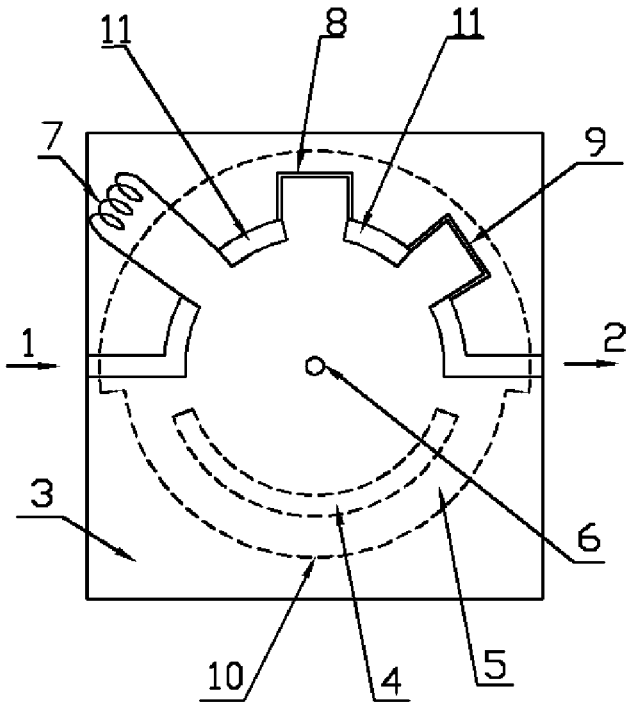
FIG. 1 is a schematic diagram of a variable inductor in accordance with a first embodiment of the invention.

As shown in FIG. 1, the variable inductor comprises a substrate 3 having a surface layer and an inner layer, a signal input terminal 1 disposed on the surface layer of the substrate 3, a signal output end 2, a conductive sheet 4, an insulator 5, a signal microstrip line 11 and three fixed inductors 7, 8 and 9. In this embodiment, the insulator 5 is a printed circuit board, the fixed inductor 7 is a discrete fixed inductor, the fixed inductors 8 and 9 are microstrip line inductors.

The conductive sheet 4 is disposed on the insulator 5 for controlling the fixed inductors 7, 8 and 9. One side of the conductive sheet 4 is contacted with one end of the insulator 5, and the other side of the conductive sheet 4 is contacted with the surface layer of the substrate 3

The insulator 5 is for moving or rotating the conductive 4. In this embodiment, the insulator 5 is round-shaped, and on a same axis as the substrate 3. As the insulator 5 rotates, a position of the conductive sheet 4 is correspondingly changed, the fixed inductors 7, 8 and 9 are shorted and disabled, and thus inductance thereof is stepwise adjusted.

A positioning groove 10 is disposed at an outer edge of the insulator 5 for limiting a rotating angle thereof.

The fixed inductors 7, 8 and 9 are connected in series via the signal microstrip line 11 to form a serial fixed inductor. One end of the serial fixed inductor is connected to the signal input terminal 1, and the other end of the serial fixed inductor is connected to the signal output terminal 2.

Figure 2:
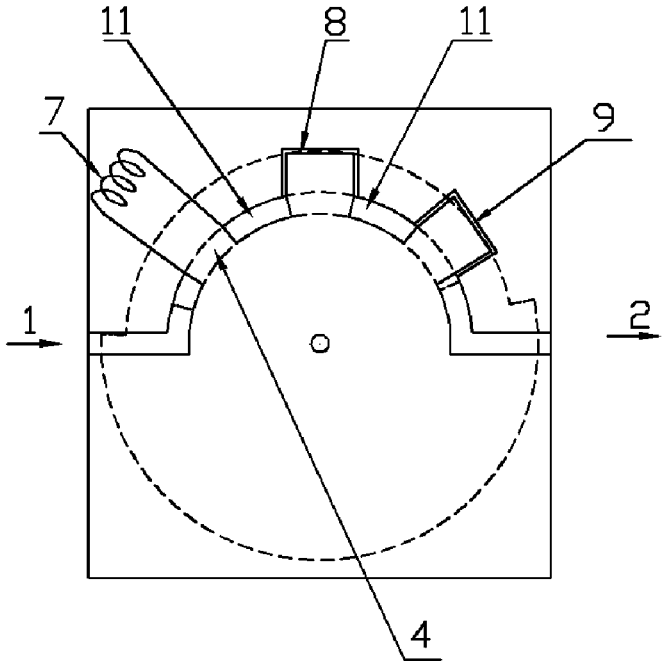
FIG. 2 illustrates a variable inductor in accordance with a second embodiment of the invention where a conductive sheet of the variable inductor disables different fixed inductors.

As shown in FIG. 2, signals from the signal input terminal 1 do not pass the fixed inductors 7, 8 and 9, but are transferred to the signal output end 2 via the signal microstrip line 11 and the conductive sheet 4. In this embodiment, a width of the conductive sheet 4 is the same as that of the signal microstrip line 11.

Figure 3A:
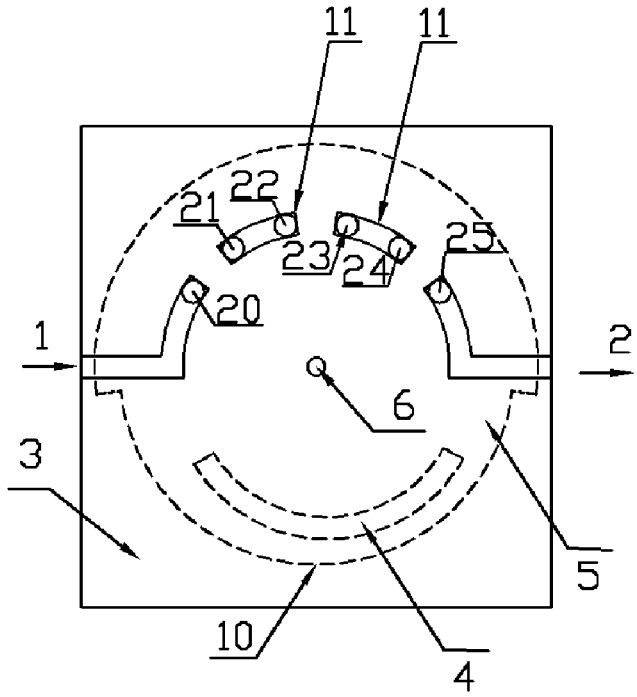
FIG. 3*a* is a schematic diagram of a variable inductor in accordance with a second embodiment of the invention.
Figure 3B:
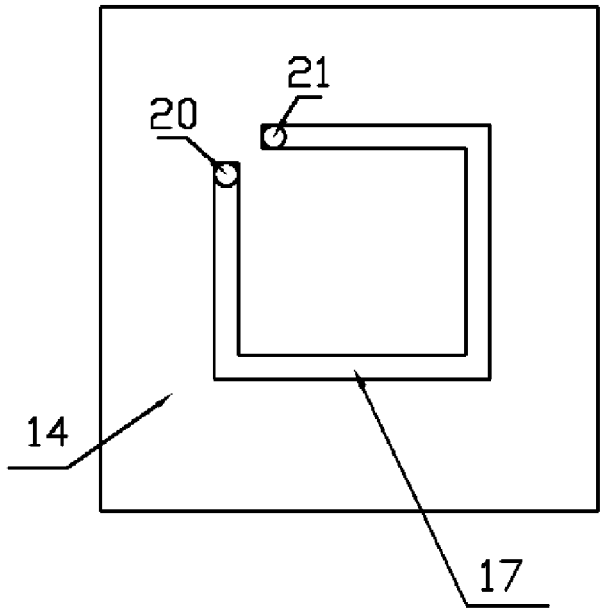
FIGS. 3*b*-3*d* illustrate fixed inductors on a second, third and fourth layer of a substrate of a variable inductor in accordance with a second embodiment of the invention.
Figure 3C:
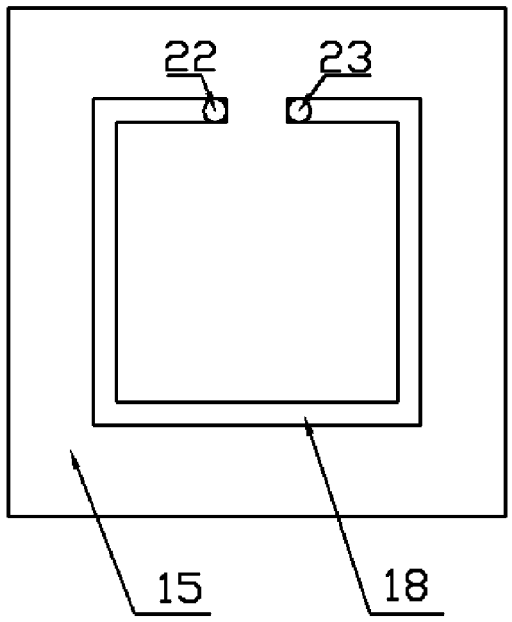
Figure 3D:
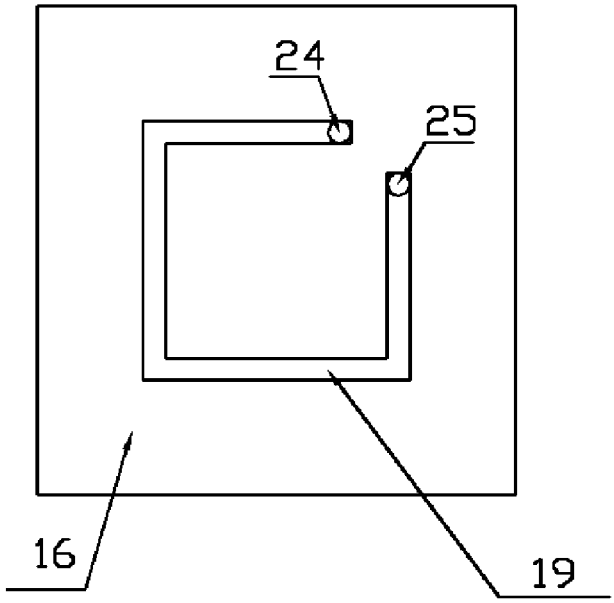

As shown in FIGS. 3*b*-3*d*, the variable inductor comprises a substrate 3 having multiple layers, a signal input terminal 1, a signal output end 2, a conductive sheet 4, an insulator 5, a signal microstrip line 11, and three fixed inductors 17, 18 and 19. In this embodiment, the insulator 5 is a printed circuit board, and the fixed inductors 17, 18 and 19 are microstrip line inductors.

The substrate 3 is a multi-layered substrate, and a signal input terminal 1, a signal output terminal 2 and a signal microstrip line 11 are disposed on a surface layer (first layer) of the substrate 3.

As shown in FIGS. 3*b*-3*d*, the fixed inductors 17, 18 and 19 are disposed on a second layer 14, a third layer 15 and a fourth layer 16 of the substrate 3, and connected to the surface layer of the substrate 3 via a through hole. In detail, one end of the fixed inductor 17 is connected to a port 20 of the surface layer, and the other end of the fixed inductor 17 is connected to port 21 of the surface layer. One end of the fixed inductor 18 is connected to a port 22 of the surface layer, and the other end of the fixed inductor 18 is connected to port 23 of the surface layer. One end of the fixed inductor 19 is connected to a port 24 of the surface layer, and the other end of the fixed inductor 19 is connected to port 25 of the surface layer. The fixed inductors 17, 18 and 19 are connected with each other in series via the signal microstrip line 11, to form a serial fixed inductor. One end of the serial fixed inductor is connected to the signal input terminal 1, and the other end of the serial fixed inductor is connected to the signal output terminal 2.

The conductive sheet 4 is disposed on the insulator 5 for shorting the fixed inductors 17, 18 and 19. One side of the conductive sheet 4 is contacted with one end of the insulator 5, and the other side of the conductive sheet 4 is contacted with the surface layer of the substrate 3.

The insulator 5 is utilized for moving or rotating the conductive 4. In this embodiment, the insulator 5 is round-shaped, and is disposed on a same axis as the substrate 3. As the insulator 5 rotates, the position of the conductive sheet 4 is correspondingly changed, the fixed inductors 17, 18 and 19 are shorted and disabled, and thus inductance thereof is stepwise adjusted.

A positioning groove 10 is disposed at an outer edge of the insulator 5 for limiting a rotating angle of the insulator 5.

The fixed inductors 17, 18 and 19 are connected in series via the signal microstrip line 11 to form a serial fixed inductor. One end of the serial fixed inductor is connected to the signal input terminal 1, and the other end of the serial fixed inductor is connected to the signal output terminal 2.

Figure 4:
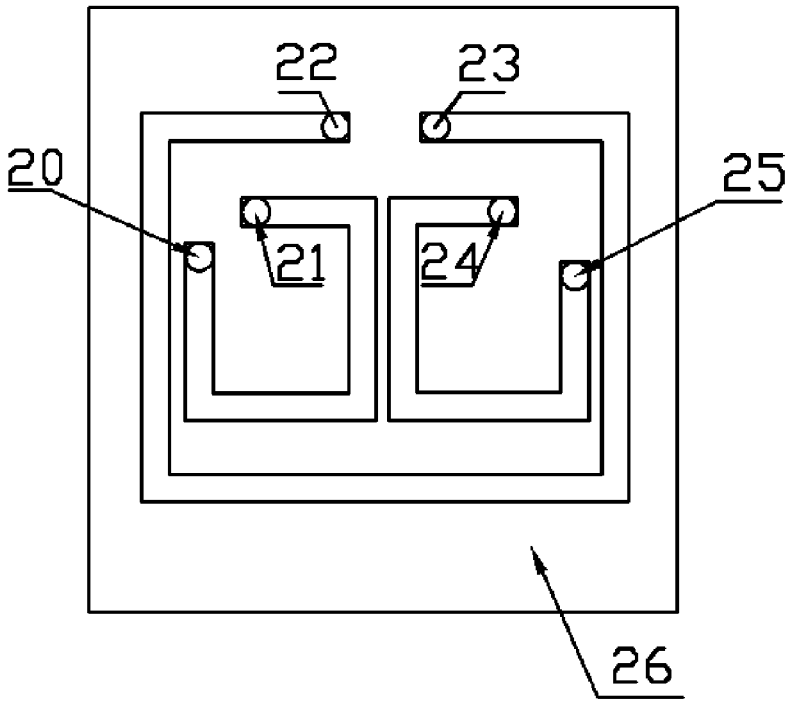
FIG. 4 is a schematic diagram of a variable inductor in accordance with a third embodiment of the invention.
Figure 5A:
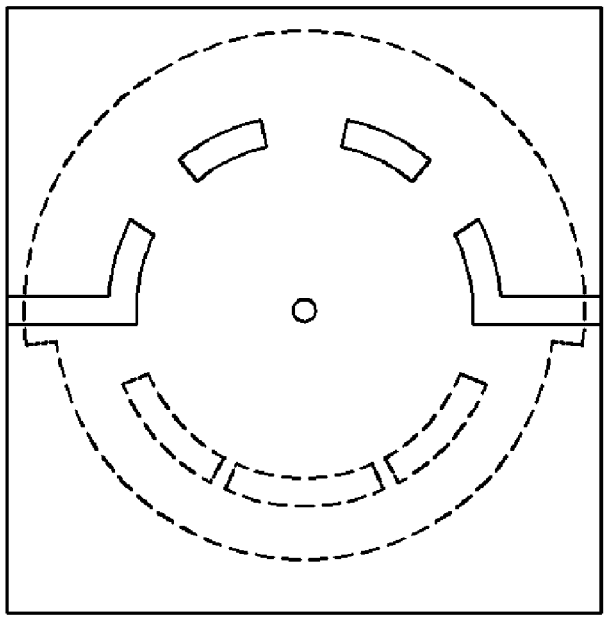
FIGS. 5*a*-5*d* illustrate an inductor in accordance with a fourth embodiment of the invention where a conductive sheet of a variable inductor disables different fixed inductors.
Figure 5B:
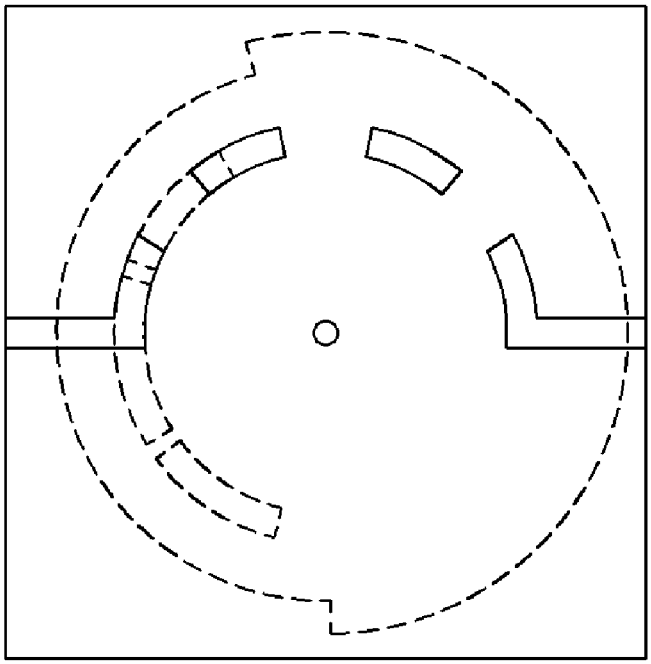
Figure 5C:
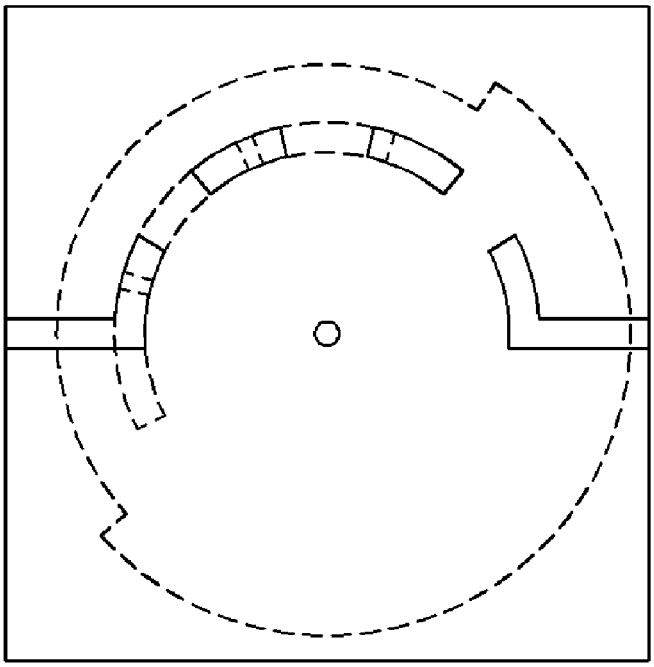
Figure 5D:
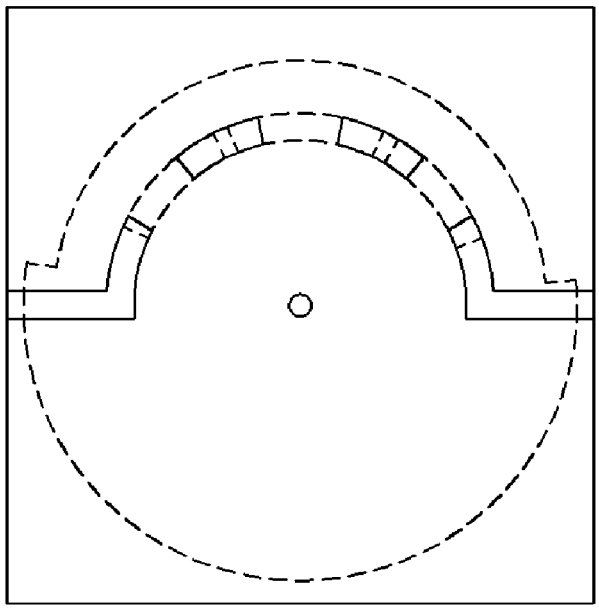

As shown in FIG. 4, in this embodiment, the fixed inductors are disposed on the same layer 26 of the substrate 3 and both ends of the fixed inductors 20, 21, 22, 23, 24, 25 and 26 are connected to the surface layer thereof via a through hole.

As shown in FIGS. 5*a*-5*d*, the conductive sheet is a graded combination of a plurality of sheets, which is able to decrease an extra capacitance effect caused by contact of the conductive sheet and a signal microstrip line.

Figure 6:
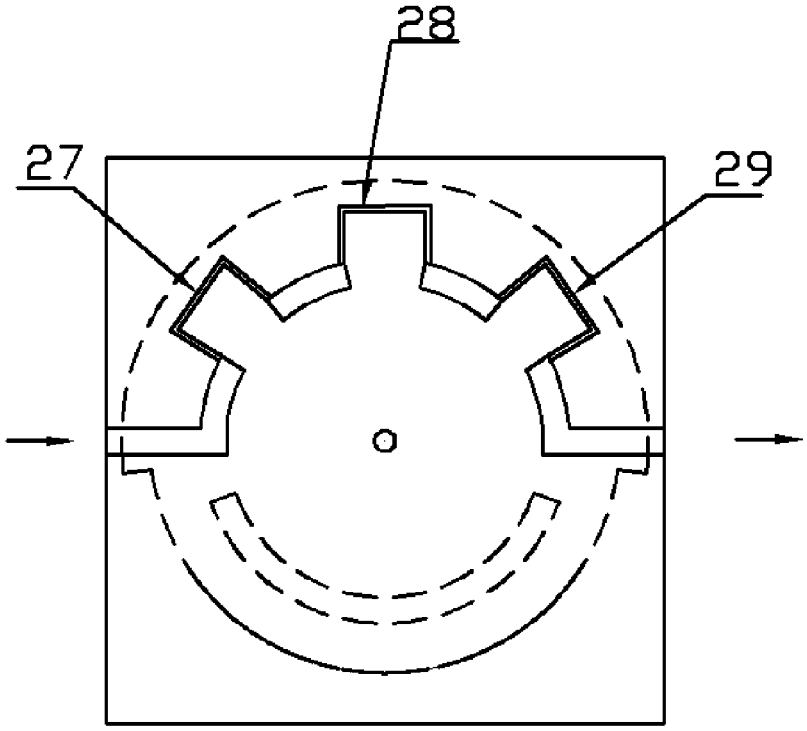
FIG. 6 is a schematic diagram of a variable inductor in accordance with a fifth embodiment of the invention.

As shown in FIG. 6, the variable inductor is a graded variable inductor, which means that inductance values of the fixed inductors 27, 28 and 29 are the same, and therefore increments thereof are the same. The graded variable inductor is adjusted ascendingly and/or descendingly.

Figure 7:
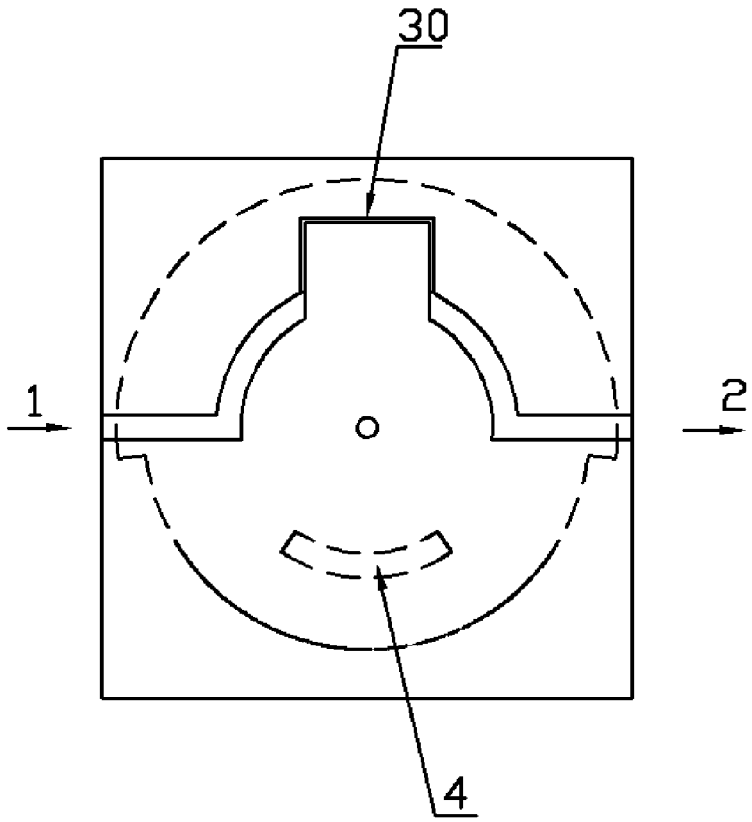
FIG. 7 is a schematic diagram of a variable inductor in accordance with a sixth embodiment of the invention.

As shown in FIG. 7, the variable inductor comprises a substrate having a surface layer and a inner layer, a single fixed inductor 30, a signal input terminal 1, a signal output terminal 2, a conductive sheet 4, and an insulator.

In this embodiment, the conductive sheet 4 is a switch, the insulator is a printed circuit board, and the fixed inductor 30 is a microstrip line inductor or a discrete inductor.

One end of the fixed inductor 30 is connected to a signal input terminal 1 and the other end of the fixed inductor 30 is connected to a signal output terminal 2.

The conductive sheet 4 or the switch shorts the fixed inductor 30, and inductance value thereof is reduced to zero.

The conductive sheet 4 is disposed on the insulator. One end of the conductive sheet 4 is connected to the insulator, and the other end of the conductive sheet 4 is connected to a surface layer of the substrate 3.

A positioning groove is disposed at an outer edge of the insulator.

The fixed inductor 30 is located on the surface layer or the inner layer of the substrate when the fixed inductor 30 is a microstrip line inductor. If the fixed inductor 30 is located on the inner layer of the substrate and short circuit of the fixed inductor 30 is controlled by the conductive sheet, both ends of the fixed inductor 30 are connected to the surface layer of the substrate. If the fixed inductor 30 is a discrete inductor, the fixed inductor 30 is located on the surface layer of the substrate. The fixed inductor 30 is located on the same or on a different layer of the substrate as the switch is located. If the fixed inductor 30 is located on a different layer of the substrate from the switch, both ends of the fixed inductor 30 are connected to the layer on which the switch is located.

Figure 8A:
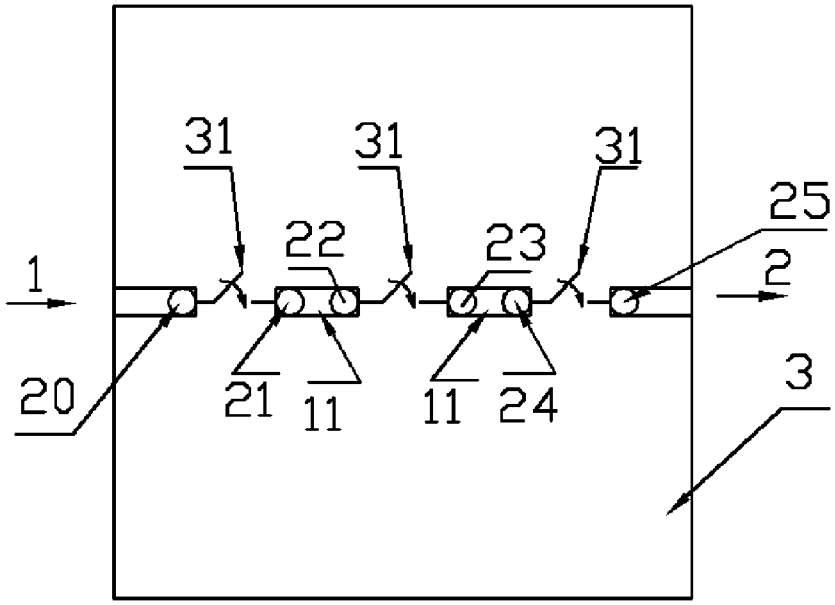
FIGS. 8*a* and 8*b* are schematic diagrams of a variable inductor in accordance with a seventh embodiment of the invention.
Figure 8B:
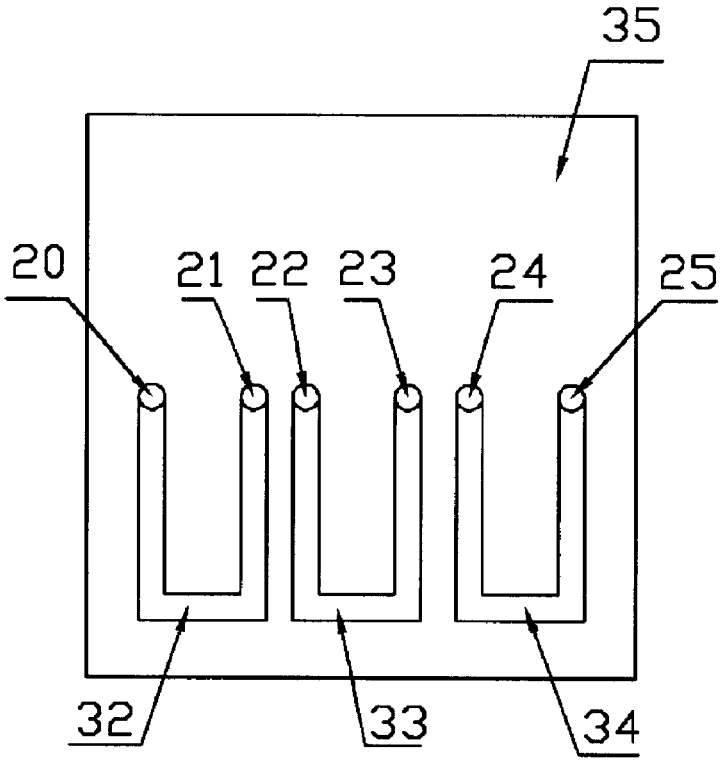

As shown in FIGS. 8*a* and 8*b*, fixed inductors 32, 33 and 34 are on a different layer of the substrate 3 from the switch 31, and are connected to a surface layer of the substrate 3 via a through hole. In detail, one end of the fixed inductor 32 is connected to a port 20 of the surface layer, and the other end of the fixed inductor 32 is connected to port 21 of the surface layer. One end of the fixed inductor 33 is connected to a port 22 of the surface layer, and the other end of the fixed inductor 33 is connected to another port 23 of the surface layer. One end of the fixed inductor 34 is connected to a port 24 of the surface layer, and the other end of the fixed inductor 34 is connected to another port 25 of the surface layer. The fixed inductors 32, 33 and 34 are connected in series with one another via the signal microstrip line 11, to form a serial fixed inductor. One end of the serial fixed inductor is connected to the signal input terminal 1, and the other end of the serial fixed inductor is connected to the signal output terminal 2.

The variable inductor further comprises at least one switch for short-circuiting the fixed inductors. In this embodiment, three switches are used; one end of each of the switches is connected to one end of each of the fixed inductors; and the other end of each of the switches is connected to the other end of each of the fixed inductors.

The switch 31 is switched on or off via an external trigger signal. As the switch 31 is switched off, the fixed inductor connected thereto is disabled, and in this way the variable inductor is stepwise adjusted.

The switch 31 employs a microwave high-speed switching tube (such as a PIN tube) or a field effect transistor (FET) as a switching tube. In designing the switch 31, ON/OFF trigger signals (control signal) of different switches need to be isolated. This is realized by adding coupling capacitors between the switches, which capacitors pass radio frequency microwave signals and prevent the low frequency ON/OFF trigger signals from passing. Moreover, high-impedance lines are added between the ON/OFF trigger signals and the switches, so as to prevent the radio frequency microwave signals from leaking from the ON/OFF trigger signals.

The switch is disposed on the surface or the inner layer of the substrate. For example, when the substrate is a silicon or a gallium arsenide substrate, both the switch and the fixed inductors are integrated therein.

Figure 9:
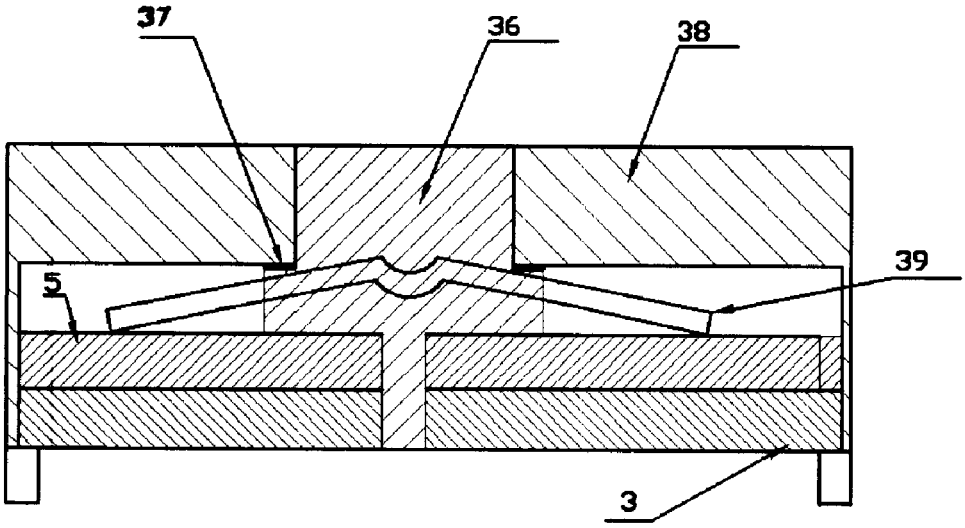
FIG. 9 is a sectional view of a variable inductor in accordance with one embodiment of the invention.
Figure 10A:
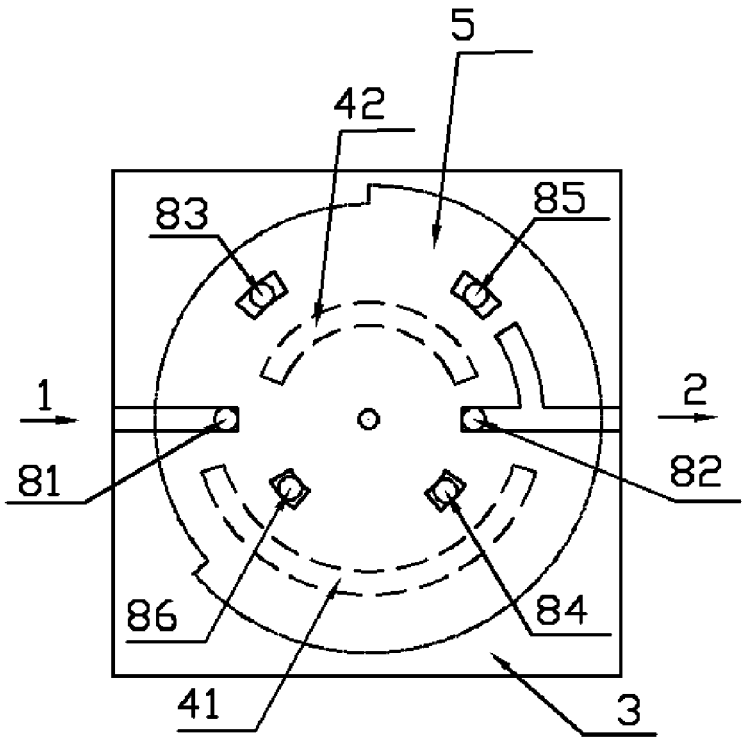
FIG. 10*a* is a schematic diagram of a variable inductor in accordance with an eighth embodiment of the invention.
Figure 10B:
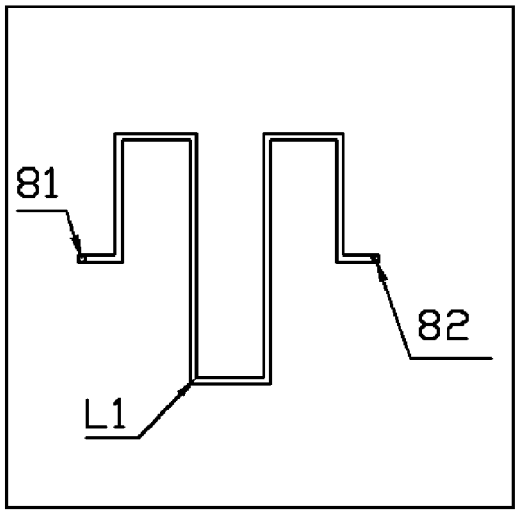
FIGS. 10*b*-10*d* illustrate fixed inductors on different layers of a substrate of a variable inductor in accordance with an eighth embodiment of the invention.
Figure 10C:
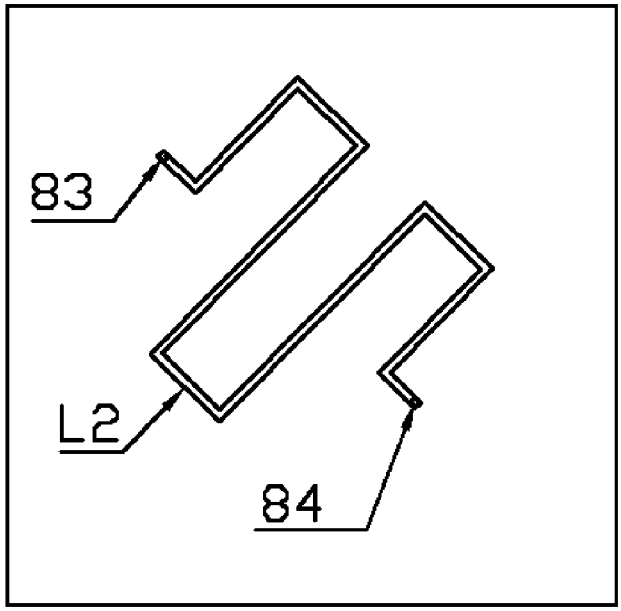
Figure 10D:
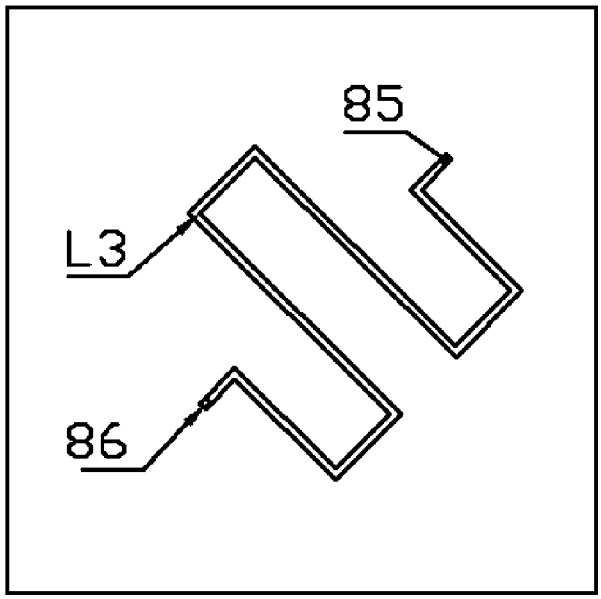

As shown in FIG. 9, to allow for free rotation, an axis 36 is disposed at the center of an insulator and a substrate 3.

A pad 39, which is rigid in the rotating direction and elastic in the vertical direction, is disposed between the insulator and a housing 38 of the variable inductor, so as to enable the conductive sheet to stably contact with the signal microstrip line.

A rubber pad 37 is disposed inside the axis 36 and the housing 38 for stabilization.

A positioning rod (not shown) engaged with the positioning groove 10 is disposed in the housing, so as to limit a rotating angle and prevent over-adjustment.

In a case that the variable inductor only comprises one fixed inductor, one end of the fixed inductor is connected to the signal input terminal, and the other end of the fixed inductor is connected to the signal output terminal. At this point, adjustment of the variable inductor is realized by short-circuiting the fixed inductor via the conductive sheet or the switch.

Detailed description of a variable inductor formed by parallel connection will be given below.

As shown in FIGS. 10*a*-10*d*, the variable inductor comprises a substrate 3 having multiple layers, a signal input terminal 1, a signal output end 2, a conductive sheets 41 and 42, an insulator 5, and three fixed inductors L1, L2 and L3. In this embodiment, the insulator 5 is a round printed circuit board, and the fixed inductors L1, L2 and L3 are microstrip line inductors.

The fixed inductors L1, L2 and L3 are located on different layers of the substrate 3, and are respectively connected to three pair of ports 81 and 82, 83 and 84, and 85 and 86 of the substrate 3 via a through hole.

The fixed inductors L1, L2 and L3 are connected via conductive sheets 41 and 42 to form a parallel inductor. In another embodiment, one end of each of the fixed inductors L1, L2 and L3 are connected altogether, and the other end of the fixed inductors L1, L2 and L3 is connected altogether via the conductive sheets 41 and 42 or a switch.

One end of the parallel inductor is connected to the signal input terminal 1, and the other end of the parallel inductor is connected to the signal output terminal 2.

The insulator 5 is for moving the conductive sheets 41 and 42.

A positioning groove 10 is disposed on an outer edge of the insulator 5 for limiting movement of the conductive sheets 41 and 42.

The conductive sheets 41 and 42 are located on the insulator 5, and contacted with the surface layer of the substrate 3. Rotation of the insulator 5 drives the conductive sheets 41 and 42 to rotate, the fixed inductors L1, L2 and L3 are correspondingly connected or disconnected, and thus inductance thereof is adjusted.

As shown in FIGS. 11A-11D and 11*a*-11*d*, three fixed inductors L1, L2 and L3 are connected in parallel via conductive sheets 41 and 42 to form a parallel fixed inductor. Both ends of the parallel fixed inductor are connected to the signal input terminal 1 and the signal output terminal 2, respectively.

Figure 11A:
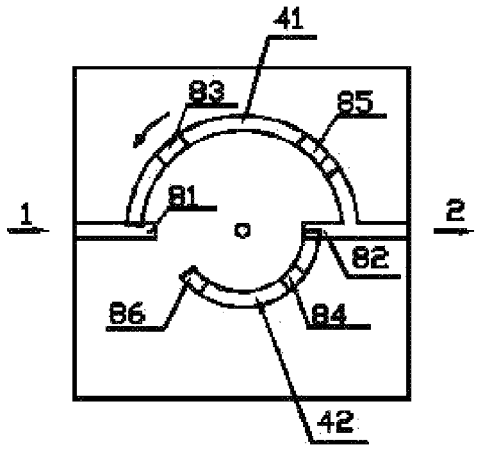
FIGS. 11A-11D and 11*a*-11*d* illustrate a process of adjusting a parallel variable inductor.
Figure 11A:
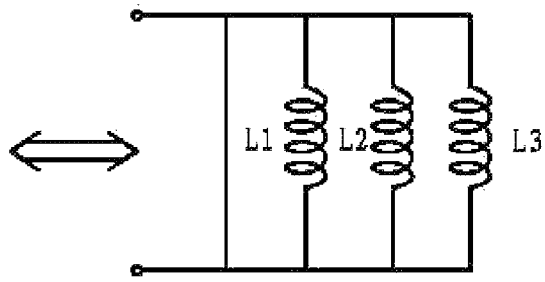

With reference to FIG. 11A, the conductive sheet 41 connects ports 81, 83 and 85, the signal input terminal 1 with the signal output terminal 2, and the conductive sheet 42 connects ports 82, 84 and 86. At this point, the conductive sheet 41 is regarded to be directly connected to the signal input terminal 1 and the signal output terminal 2. In another embodiment, a switch or a conductive sheet is disposed between the signal input terminal 1 and the signal output terminal 2.

FIG. 11*a* is an equivalent circuit of FIG. 11A, the inductance of the variable inductor is zero.

Figure 11B:
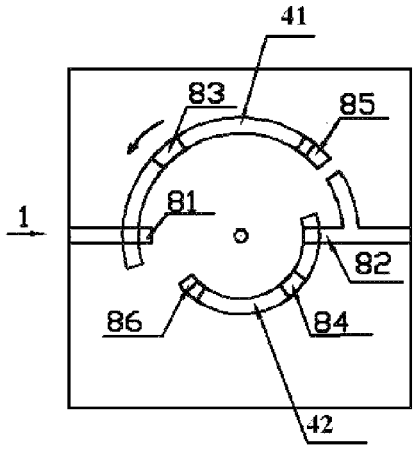
Figure 11B:
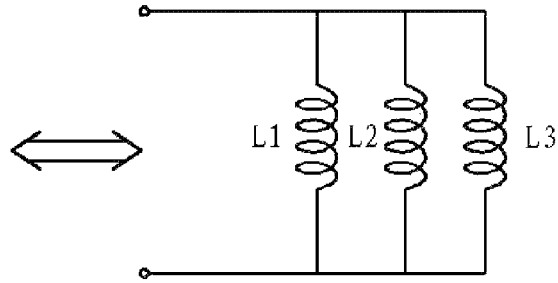

With reference to FIG. 11B, as the insulator rotates in an anticlockwise fashion to disconnect the conductive sheet 41 from the signal output terminal 2, the conductive sheet 42 also rotates. Since the conductive sheet 42 is designed to have an extra length, as the conductive sheet 41 maintains a connection with the port 85, the conductive sheet 42 is also connected with the port 86. In this scenario, an equivalent circuit is shown as FIG. 11*b*, and an overall inductance of the variable inductor is a parallel inductance of the fixed inductors L1, L2 and L3.

Figure 11C:
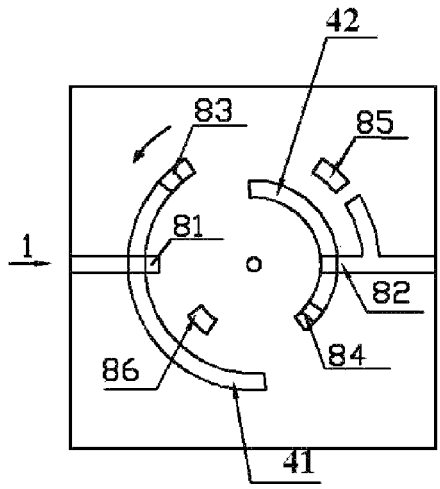
Figure 11C:
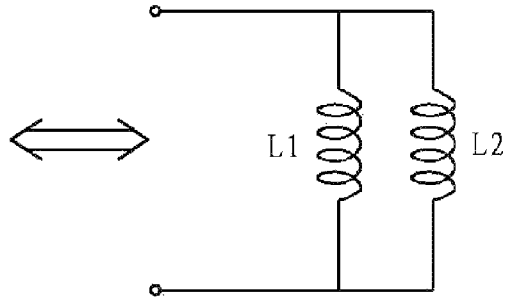

With reference to FIG. 11C, as the insulator continues rotating so that the conductive sheets 41 and 42 are respectively disconnected from the ports 85 and 86, the equivalent circuit is shown in FIG. 11*c*, and at this point, the overall inductance of the variable inductor is a parallel inductance of the fixed inductors L1 and L2.

Figure 11D:
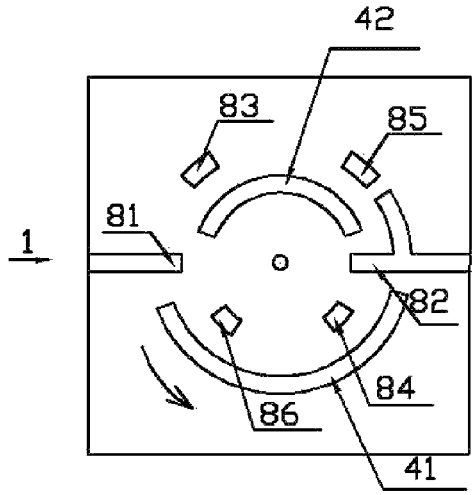
Figure 11D:
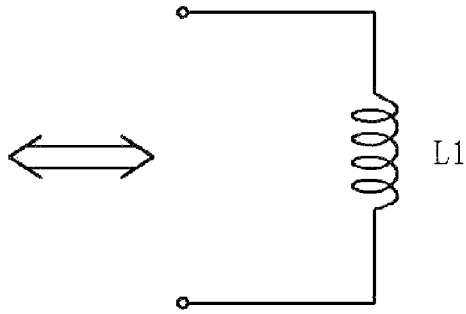

With reference to FIG. 11D, as the insulator continues rotating so that the conductive sheet 41 is not connected to the ports 83 and 85, and the conductive sheet 42 is not connected to ports 84 and 86, the equivalent circuit is shown in FIG. 11*c*, the overall inductance of the variable inductor is a inductance of the fixed inductors L1. The insulator may continue rotating, so that the conductive sheets 41 and 42 may deviate from the signal input terminal 1 and the signal output terminal 2, and the conductive sheets 41 and 42 will not have a capacitance effect on a signal. Meanwhile, the insulator is prevented from rotating excessively, so as to prevent the conductive sheet 41 from being connected to the signal output terminal 2. At this point, the positioning groove prevents the insulator from excessively rotating.

Moreover, one conductive sheet 41 only may be used to realize adjustment of the inductance: one end of the parallel fixed inductor is connected to the conductive sheet 41, and the other end of the parallel fixed inductor is connected to the signal output terminal 2. In this way, a high-frequency microwave performance of the parallel fixed inductor is insufficient; therefore in this embodiment, two conductive sheets 41 and 42 are used.

In this embodiment, the fixed inductor is a microstrip line inductor, a discrete inductor or a combination thereof. When the discrete inductor is used, it is disposed on a surface layer of the substrate.

As shown in FIGS. 12A-12D and 12*a*-12*d*, the variable inductor comprises at least two fixed inductors. In this embodiment, the fixed inductors are microstrip inductors, and three fixed inductors L1, L2 and L3 are used.

Figure 12A:
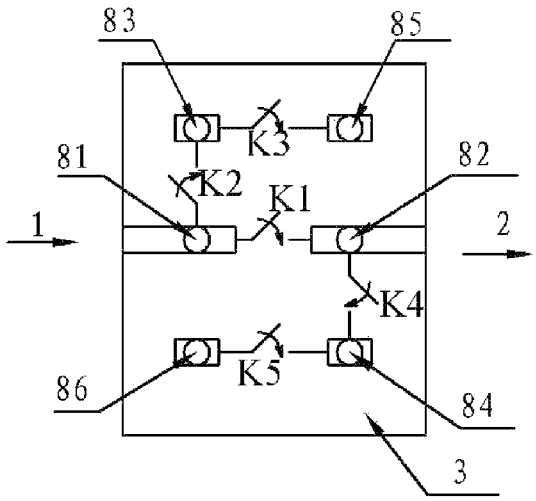
Figure 12A:
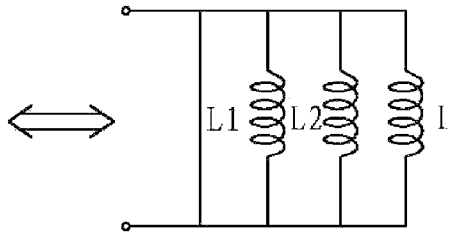

As shown in FIG. 12A, the fixed inductors L1, L2 and L3 are disposed on different layers of the substrate 3, and are respectively connected to three pairs of ports 81 and 82, 83 and 84, and 85 and 86 on the surface layer of the substrate 3 via a through hole.

The fixed inductor L1, L2 and L3 are connected to each other via four switches k2, k3, k4 and k5 to form a parallel fixed inductor. Both ends of the parallel inductor are respectively connected to the signal input terminal 1 and the signal output terminal 2. The fixed inductors L1, L2 and L3 are on different layers of the substrate from where the switches k2, k3, k4 and k5 are located. A switch k1 for resetting the variable inductor is disposed between the ports 81 and 82.

The parallel fixed inductor is equivalent to an inductor, and therefore a function of the switch k1 is the same as the conductive sheet 4 in FIG. 7. As the switch k1 is switched on, the signal input terminal is connected to the signal output terminal, and an inductance of the variable inductor is zero.

FIG. 12*a* illustrates an equivalent circuit of the inductor illustrated in FIG. 12A.

With reference to FIG. 12C, the switches k1, k3 and k5 are switched off, and the switches k2 and k4 are switched on, the parallel fixed inductor is a parallel connection of the fixed inductors L1 and L2, and an overall inductance of the variable inductor is a parallel inductance of the fixed inductor L1 and L2.

Figure 12B:
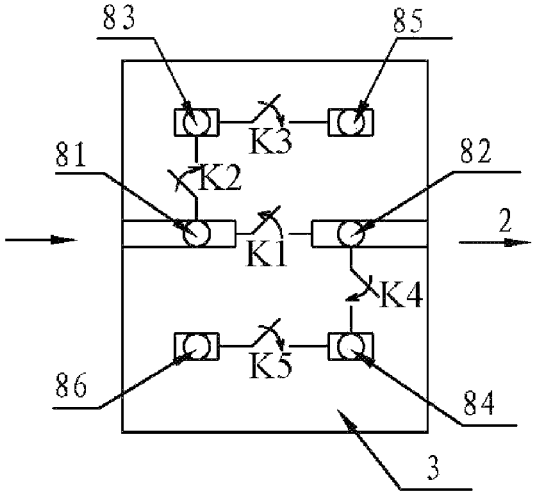
Figure 12B:
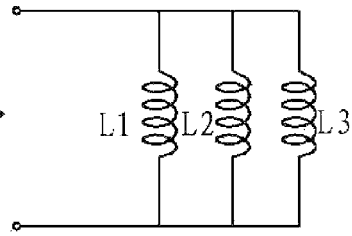

FIG. 12*b* is an equivalent circuit of FIG. 12B.

With reference to FIG. 12D, the switches k1, k2, k3, k4 and k5 are switched off, the parallel fixed inductor is the fixed inductors L1, and an overall inductance of the variable inductor is that of the fixed inductor L1.

FIG. 12*d* illustrates an equivalent circuit of the inductor illustrated in FIG. 12D.

The switch is switched on or off via an external trigger signal. The switch may employ a microwave high-speed switching tube (such as a PIN tube) or a field effect transistor (FET) as a switching tube. In designing the switch 31, ON/OFF trigger signals (control signal) of different switches need to be isolated, this can be realized by adding coupling capacitors between the switches, which capacitors can pass radio frequency microwave signals and prevent the low frequency On/OFF trigger signals from passing. Moreover, high-impedance lines are added between the ON/OFF trigger signals and the switches, so as to prevent the radio frequency microwave signals from leaking from the ON/OFF trigger signals.

The switch is disposed on the surface layer or the inner layer of the substrate. For example, if the substrate is a silicon or a gallium arsenide substrate, both the switch and the fixed inductors is integrated therein. Popularly, in a monolithic microwave integrated circuit (MMIC), inductors are integrated with discrete circuits.

Moreover, as a fixed inductor is connected in parallel or switched off, it is only required to arrange a switch at one end thereof. Taking FIG. 12 as an example, the switches k4 and k5 are not required, by way of connecting the ports 84 and 86 to the signal output terminal 2, an inductance of the variable inductor is adjusted. However, this will affect the high-frequency microwave performance of the parallel fixed inductor.

The fixed inductor is a microstrip line inductor, a discrete inductor or a combination thereof. When a discrete inductor is used, it is disposed on the surface layer of the substrate.

Figure 13:
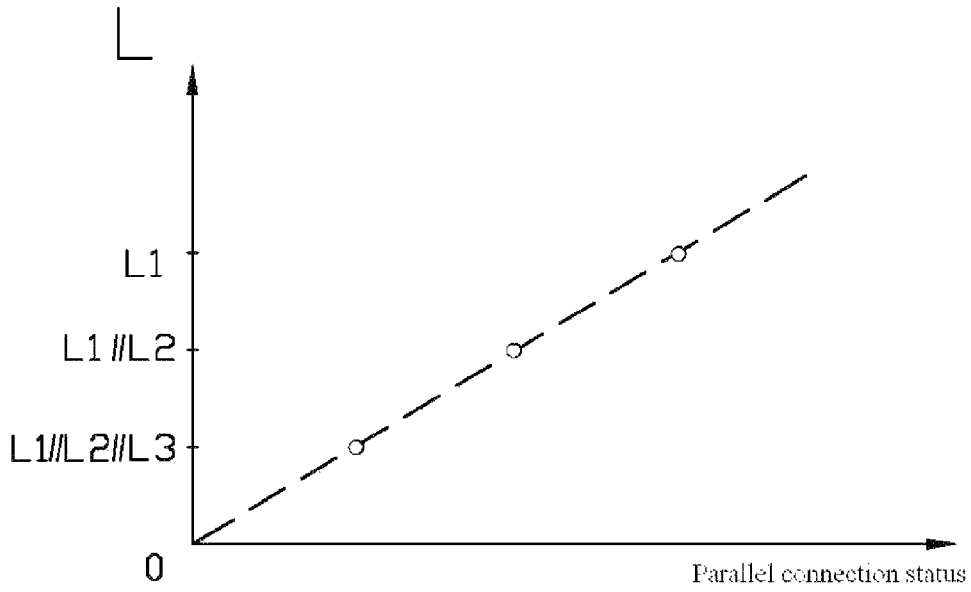
FIG. 13 is a theoretical curve of a parallel fixed inductor.

FIG. 13 is a theoretical curve of a variable inductor in a scenario when a parallel fixed inductor is used, where the vertical axis is an inductance, and the horizontal axis is a parallel connection status of the fixed inductor.

Figure 14:
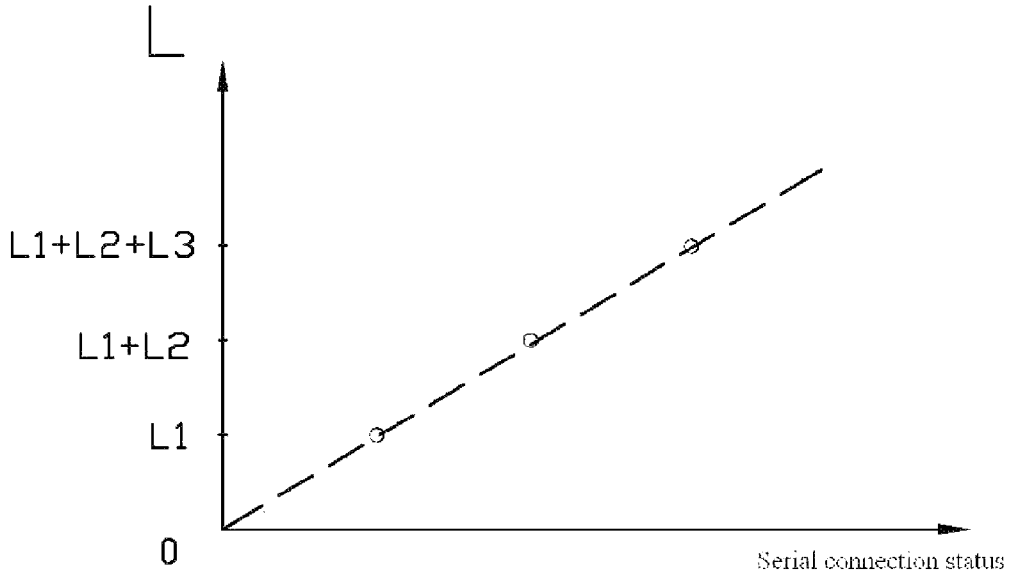
FIG. 14 is a theoretical curve of a serial fixed inductor.

FIG. 14 is a theoretical curve of a variable inductor in a scenario when a serial fixed inductor is used, where the vertical axis is an inductance, and the horizontal axis is a serial connection status of the fixed inductor.

In this invention, the number of fixed inductors of the variable inductor may be one or more. These inductors are disposed on each layer of the substrate, and the microstrip inductor is, without limitation, in a shape of a spiral, a snake, an open square, a single line, and so on.

The substrate is a printed circuit board with good high-frequency or microwave performance. The substrate is not limited to the printed circuit board, and may be other materials, comprising semiconductive materials such as silicon or gallium arsenide widely used in radio frequency integrated circuits and monolithic microwave integrated circuits.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A variable inductor, comprising a substrate having a surface layer and an inner layer;

a plurality of fixed inductors disposed on said substrate;

a signal microstrip line connecting the fixed inductors to one another in series forming a serial fixed inductor;

a conductive sheet having a first side and a second side;

an insulator;

a signal input terminal; and a signal output terminal;

wherein one end of said serial fixed inductor is connected to said signal input terminal, and the other end of said serial fixed inductor is connected to said signal output terminal;

said first side is connected to said insulator and said second side is contacted with said surface layer;

said signal input terminal, said signal output terminal, and said signal microstrip line are disposed on said surface layer;

said insulator is movable and when said insulator is moved, said conductive sheet moves with said insulator whereby controlling inductance of the variable inductor.

2. The variable inductor of claim 1, wherein said insulator is a printed circuit board, and said printed circuit supports said conductive sheet; and a positioning groove is disposed at an outer edge of said insulator.

3. The variable inductor of claim 1, wherein said fixed inductor is a microstrip line inductor or a discrete inductor;

when said fixed inductor is a microstrip line inductor, said fixed inductor is located on the surface layer or the inner layer;

when said fixed inductor is located on the inner layer and short-circuiting of said fixed inductor is controlled by said conductive sheet, both ends of said fixed inductor are connected to the surface layer; and when said fixed inductor is a discrete inductor, said fixed inductor is located on the surface layer.

4. The variable inductor of claim 1, wherein said insulator moves on a surface that is parallel to said surface layer.

5. The variable inductor of claim 1, wherein said insulator moves on a surface that is parallel to said surface layer, and said insulator moves on a circular path.

6. A variable inductor, comprising a substrate having a surface layer and an inner layer;

a plurality of fixed inductors disposed on said substrate, each of said plurality of fixed inductors being connected to an input port and an output port, respectively;

at least one conductive sheet having a first side and a second side;

an insulator;

a signal input terminal; and a signal output terminal;

wherein said input ports, said output ports, said signal input terminal, and said signal output terminal are disposed on the surface layer;

said first side is connected to said insulator and said second side is contacted with said surface layer; and said insulator is movable and when said insulator is moved, said conductive sheet is moved with said insulator whereby controlling electrical connections of said input ports, said output ports, said signal input terminal, and said signal output terminal, and whereby controlling inductance of the variable inductor.

7. The variable inductor of claim 6, wherein one set of ends of said plurality of fixed inductors are joined together and connected to said signal input terminal or said signal output terminal, and the other set of ends are joined together via said conductive sheet.

8. The variable inductor of claim 6, wherein a set of ends of said plurality of fixed inductors are joined together via a first conductive sheet, and the other set of ends are joined together via a second conductive sheet.

9. The variable inductor of claim 6, wherein said insulator is a printed circuit board for supporting, and said printed circuit supports said conductive sheet; and a positioning groove is disposed at an outer edge of said insulator.

10. The variable inductor of claim 6, wherein said fixed inductor is a microstrip line inductor or a discrete inductor;

when said fixed inductor is a microstrip line inductor, said fixed inductor is located on the surface layer or the inner layer;

when said fixed inductor is located on the inner layer and short circuit of said fixed inductor is controlled by said conductive sheet, both ends of said fixed inductor are connected to the surface layer; and when said fixed inductor is a discrete inductor, said fixed inductor is located on the surface layer.

11. The variable inductor of claim 6, wherein said signal input terminal is connected to said signal output terminal via said conductive sheet, and said conductive sheet is disposed between said signal input terminal and said signal output terminal.

12. The variable inductor of claim 6, wherein said insulator moves on a surface that is parallel to said surface layer.

13. The variable inductor of claim 6, wherein said insulator moves on a surface that is parallel to said surface layer, and said insulator moves on a circular path.

14. A variable inductor, comprising a substrate having a surface layer and an inner layer;

a plurality of fixed inductors disposed on said substrate and each of said plurality fixed inductors being connected to an input port and an output port, respectively;

a first conductive sheet having a first side and a second side, and a second conductive sheet having a third side and a fourth side;

an insulator;

a signal input terminal; and a signal output terminal;

wherein said input ports, said output ports, said signal input terminal, and said signal output terminal are disposed on the surface layer;

said first side is connected to said insulator and said second side is contacted with the surface layer;

said third side is connected to said insulator and said fourth side is contacted with the surface layer;

said input ports are connected to said signal input terminal via said first conductive sheet;

said output ports are connected to said signal output terminal via said second conductive sheet; and said insulator is movable and when said insulator is moved, said first conductive sheet and said second conductive sheet move with said insulator whereby controlling electrical connections of said input ports, said output ports, said signal input terminal, and said signal output terminal, and whereby controlling inductance of the variable inductor.

15. The variable inductor of claim 14, wherein said input ports are further connected to the signal output terminal via said first conductive sheet.

16. The variable inductor of claim 14, wherein said insulator is a printed circuit board, and said printed circuit board supports said conductive sheet; and a positioning groove is disposed at an outer edge of said insulator.

17. The variable inductor of claim 14, wherein said fixed inductor is a microstrip line inductor or a discrete inductor;

when said fixed inductor is a microstrip line inductor, said fixed inductor is located on the surface layer or the inner layer;

when said fixed inductor is located on the inner layer and short circuit of said fixed inductor is controlled by said first conductive sheet and said second conductive sheet, both ends of said fixed inductor are connected to the surface layer; and when said fixed inductor is a discrete inductor, said fixed inductor is located on the surface layer.

18. The variable inductor of claim 14, wherein said insulator moves on a surface that is parallel to said surface layer.

19. The variable inductor of claim 14, wherein said insulator moves on a surface that is parallel to said surface layer, and said insulator moves on a circular path.

* * * * *